United States Patent [19]

Wegener et al.

[11] Patent Number: 4,820,448

[45] Date of Patent: Apr. 11, 1989

[54] SURFACTANT MIXTURES AND THEIR USE

[75] Inventors: Ingo Wegener, Duesseldorf; Alfred Meffert, Monheim; Ditmar Kischkel, Duesseldorf, all of Fed. Rep. of Germany

[73] Assignee: Henkel Kommanditgesellschaft auf Aktien, Duesseldorf, Fed. Rep. of Germany

[21] Appl. No.: 93,859

[22] Filed: Sep. 8, 1987

[30] Foreign Application Priority Data

Sep. 8, 1986 [DE] Fed. Rep. of Germany ..... 3630533

[51] Int. Cl.[4] ..... C11D 3/065; C11D 1/12; C11D 1/755; C11D 9/22

[52] U.S. Cl. ..... 252/533; 252/531; 252/535; 252/538; 252/550; 252/552; 252/554; 252/557; 252/174.21; 252/174.25; 252/DIG. 14; 427/220

[58] Field of Search ..... 252/140, 132, 174.13, 252/174.21, 174.25, 89.1, 531, 535, 538, 540, 550, 554, 557, 559, DIG. 1, DIG. 14, 533; 427/220

[56] References Cited

U.S. PATENT DOCUMENTS 3,415,753 12/1968 Stein et al. ..... 252/121
4,052,342 10/1977 Fernley et al. ..... 252/541
4,384,978 5/1983 Ploog et al. ..... 252/353
4,495,092 1/1985 Schmid et al. ..... 252/559
4,549,984 10/1985 Satsuki et al. ..... 252/532
4,661,281 4/1987 Seiter et al. ..... 252/140

FOREIGN PATENT DOCUMENTS 1370402 10/1974 United Kingdom .
2168994 7/1986 United Kingdom .

*Primary Examiner*—Prince E. Willis
*Assistant Examiner*—Ronald A. Krasnow
*Attorney, Agent, or Firm*—Ernest G. Szoke; Wayne C. Jaeschke; Real J. Grandmaison

[57] ABSTRACT

A low-water content surfactant mixture which is pourable and pumpable at ambient temperature having high wetting power and detergency when used in a fabric detergent composition has a water content of no more than about 20% by weight, and consists essentially of (1) from about 50 to about 65% by weight of a $C_{12}$–$C_{18}$ fatty alcohol ethoxylate containing an average of about 10 moles of ethylene oxide, (2) from about 5 to about 15% by weight of an alkali metal salt of a $C_{16}$–$C_{18}$ tallow alcohol sulfate; (3) from about 4 to about 15% by weight of a $C_{12}$–$C_{16}$ alkane sulfonate alkali metal salt and/or the disodium salt of n-octyl sulfosuccinate; and (4) from about 5 to about 13% by weight of a free $C_{16}$–$C_{18}$ fatty acid.

16 Claims, No Drawings

SURFACTANT MIXTURES AND THEIR USE

FIELD OF THE INVENTION

This invention relates to a surfactant mixture having a high active substance content and good detergent and wetting properties, yet is pumpable and pourable at room temperature and may be used to prepare powder-form detergent compositions having good flow properties.

BACKGROUND OF THE INVENTION

Most of the free-flowing, more especially powder-form, fabric detergents commercially available today are produced by spray drying or at least using spray-dried components. A particularly well-known technique is the so-called spray-mixing process. In this process, a substantial percentage of the final detergent mixture is converted by spray-drying into a free-flowing or powder-form material to which the remaining components of the final detergent are then added. In this regard, it is known in particular that the builder component, if desired together with mutual salts, may be obtained as a powder-form solid product by spray drying, and the surfactant components are subsequently added to the powder-form material thus prepared.

So far as the surfactant components are concerned, paramount importance is attributed, among the anionic surfactant components, to alkyl benzenesulfonate (ABS) which is generally used in the form of its sodium salt, usually in conjunction with nonionic surfactants, such as for example alcohol ethoxylates.

Where surfactant mixtures of the type herein are incorporated by mixing into preformed powder-form detergent components, it is important to ensure that the free-flowing powder form is sufficiently maintained in the end product. In the normal use of the surfactants and surfactant mixtures on an industrial scale, particularly those of the above-mentioned type based on ABS in admixture with nonionic surfactants, there is a practical limit of about 12% by weight surfactant in the detergent as a whole. With higher surfactant contents, the end product easily becomes tacky, particularly in a spray-mixing process. This in turn gives rise to an undesirable change in the flow properties of the end product.

An object of the present invention is to provide new surfactant mixtures which are easy to process on an industrial scale, even when used in higher concentrations than before, which do not adversely affect the flow properties of the final detergent powder and which, in addition, are at least comparable with known surfactant mixtures in the effect they have on the washing result. More particularly, an object of the present invention is to provide surfactant mixtures of the type described which are pourable and pumpable at room temperature and, as a result, can be incorporated particularly easily in preformed powder-form components of a detergent composition. Despite the free-flowing character of the surfactant mixtures, however, the final dertergent powders should not develop any undesirable tackiness at high surfactant contents so that their fluidity or free-flow properties are not impaired.

DESCRIPTION OF THE INVENTION

Other than in the operating examples, or where otherwise indicated, all numbers expressing quantities of ingredients or reaction conditions used herein are to be understood as modified in all instances by the term "about".

According to the invention, it has surprisingly been found that the following multicomponent surfactant mixture is free-flowing and pumpable at room temperature, i.e. for example at about 20° C. and also at lower temperatures and may therefore readily be incorporated in preformed powder-form constituents of the final detergent composition mixture. Despite this fluidity, the final detergent compositions show no signs of undesirable tackiness, even where up to about 20% by weight of the free-flowing surfactant mixture is incorporated, so that the desired state of a free-flowing or fluid, dry detergent composition remains fully intact.

In a first embodiment, therefore, the present invention relates to low-water content surfactant mixtures which can be poured and pumped at room temperature and which develop high wetting power and detergency when used in fabric detergent compositions, these surfactant mixtures being characterized in that they have a water content of no more than about 20% by weight, based on the aqueous surfactant mixture, and consist essentially of:

1. from 50 to 65% by weight of a $C_{12}$–$C_{18}$ fatty alcohol ethoxylate containing an average of about 10 moles of ethylene oxide;
2. from 5 to 15% by weight of a $C_{16}$–$C_{18}$ tallow alcohol sulfate in the form of an alkali metal salt, particularly the sodium salt;
3. from 4 to 15% by weight of a $C_{12}$–$C_{16}$ alkane sulfonate alkali metal salt and/or of n-octyl sulfosuccinate disodium salt; and
4. from 5 to 13% by weight of a free $C_{16}$–$C_{18}$ fatty acid.

The water content of the multicomponent mixture is preferably no more than about 15% by weight and, more especially, is at most between about 10 to 15% by weight, again based on the aqueous surfactant mixture.

The preferred quantitative ranges for components 1 to 4 of the surfactant mixture are as follows, again expressed in each case as % by weight, based on the aqueous surfactant mixture:

component 1: 57 to 62% by weight,
component 2: 7 to 10% by weight,
component 3: 8 to 12% by weight, and
component 4: 6 to 10% by weight.

An active-substance mixture particularly suitable for practical purposes may have for example the following composition (percent active substance, based on aqueous surfactant mixture):

component 1: approximately 60% by weight,
component 2: 8.5 to 9% by weight,
component(s) 3: 9 to 10% by weight, and
component 4: 8% by weight, the
remainder, water.

It is in fact extremely surprising that such low-water content surfactant mixtures of the type described herein are liquid-like masses which can be poured and pumped at room temperature. Component 1, quantitatively by far the largest component, is solid at room temperature and has a melting point of about 30° C. The tallow sulfate salts (component 2) are also solid at room temperature with melting points of from 55° to 60° C. Free tallow fatty acid (component 4) has a melting point of about 55° C. Finally, however, component(s) 3 is also solid as a salt(s). It was in no way to be expected that the incorporation of small quantities of water in such surfactant mixtures would ultimately result in the formation of free-flowing masses which can be pumped and poured under normal ambient conditions.

Where surfactant mixtures of the type herein are incorporated in preformed free-flowing or powder-form detergent components, up to 20% by weight, based on the final detergent composition, of the free-flowing surfactant mixture is taken up without any deterioration in the free-flowing solid character of the detergent components preformed in that form. The low moisture content of the surfactant mixtures used in accordance with the invention is obviously taken up by the detergent components preformed in powder form without any adverse effect upon the free-flowing powder properties of the detergent components as a whole, although at the same time the pourability or fluidity of the surfactant mixture according to the invention is lost, so that the generally powder-form, free-flowing material remains in that form.

Highly ethoxylated $C_{12}$–$C_{18}$ fatty alcohols, i.e. those containing an average of about 10 moles of ethylene oxide, for component 1 are inexpensive commercial products and are marketed, for example, by Assignee under the trade name "Dehydol 100". $C_{16}$–$C_{18}$ tallow sulfate salts (component 2) are also commercially available products and are marketed, for example, under the trade name "Sulfopon T55".

The same applies to components 3 and 4. $C_{12}$–$C_{16}$ alkane sulfonate salts (component 3) containing the $C_{12}$–$C_{16}$ alkane group in the form of an n-paraffin residue are marketed by Assignee, for example under the trade name "Hostapur SAS 60", while pure tallow fatty acid (component 4) is known, for example, under the trade name "Edenor Ti".

The n-octyl sulfosuccinate disodium salts which may be used in addition to or instead of the alkane sulfonate salt in component 3 are known compounds corresponding to the following general formula

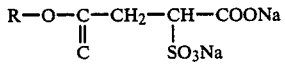

$$R-O-\underset{\underset{C}{\|}}{C}-CH_2-\underset{\underset{SO_3Na}{|}}{CH}-COONa$$

$$R = n\text{-}C_8-$$

wherein R is a straight-chain $C_8$ alkyl radical. These products are also commercially available.

In another embodiment, the invention relates to the use of the surfactant mixtures described above in the production of free-flowing, more especially powder-form fabric detergent compositions in at least partial exchange for their usual surfactant components based on ABS in admixture with alcohol ethoxylates. In this embodiment of the invention, the new surfactant mixtures are used in particular in the production of free-flowing fabric detergent compositions by the spray-mixing process. As already mentioned, the final free-flowing detergent comosition may contain up to 20% by weight of the surfactant mixture.

The detergent compositions obtained through the use of the surfactant mixture in accordance with this invention are distinguished by outstanding washing properties. This applies both to detergent compositions containing conventional builder systems based on sodium tripolyphosphate and also to the detergent formulations currently in demand which are free from phosphorus and which contain zeolite NaA, for example, as a principal builder constituent.

The surfactants and surfactant mixtures according to this invention are ecologically safe and in this respect, too, represent an important addition to the various technological possibilities herein.

EXAMPLE 1

An active-substance mixture is prepared from the components shown below. $C_{12-18}$-fatty-alcohol-10-ethoxylate (component 1) and the free tallow fatty acid (component 4) are anhydrous active substances, i.e. 100% active substances, (AS=100), while the $C_{16-18}$-tallow fatty alcohol sulfate sodium salt (component 2) and the $C_{12-16}$-alkane sulfonate salt (component 3) are used in aqueous form. In the following formulation, the percentage contents of active substance (AS) are shown in brackets.

| Surfactant mixture according to the invention | |
|---|---|
| Component 1 | 60% by weight |
| Component 2 | 16% by weight (8.8% by weight AS) |
| Component 3 | 16% by weight (9.6% by weight AS) |
| Component 4 | 8% by weight |

The viscosity of this active-substance mixture was determined in a Hoppler viscosimeter over the temperature range from 20° to 50° C., the temperature being increased in increments of 5° C.

The following viscosity values were found for the active-substance mixture which was a viscous liquid at room temperature:

| °C. | example 1 |
|---|---|
| 20 | 14 802 mPa · s |
| 25 | 14 371 mPa · s |
| 30 | 14 241 mPa · s |
| 35 | 14 176 mPa · s |
| 40 | 14 141 mPa · s |
| 45 | 14 112 mPa · s |
| 50 | 14 088 mPa · s |

The washing power of the surfactant mixture according to the invention was determined by the Launderometer test under the following conditions: 30 minutes' treatment in the Launderometer at 60° C., concentration of the detergent used was 7 g/l, and the hardness of the water used for preparing the liquor was 16° Gh (German hardness).

The following combination of active substances was used as the detergent composition:

10% by weight surfactant mixture according to the invention as above
22% by weight sodium tripolyphosphate
15% by weight zeolite NaA
5% by weight waterglass
20% by weight sodium perborate
28% by weight sodium sulfate Soiled (dust/sebum soil) standard test cloths based on unrefined cotton (C), refined polyester/cotton blend (RPC), and refined cotton (RC) were washed in successive tests with the above detergent composition.

The initial remission values of the soiled standard test cloths were as follows:

C=39.5
RPC=28.0
RC=27.6

The remission values (double determination) of the test cloths after washing with the above detergent composition, rinsing and drying were as follows:

C=64.0/64.9
RPC=85.4/83.5
RC=58.3/55.5

EXAMPLE 2

The alkane sulfonate solution of the composition of example 1 was substituted by 9% by weight of disodium salt of dioctyl sulfosuccinate and 6% by weight of water. The viscosity values were 15 100 mPa·s at room temperature and 13 900 at 50° C. The washing tests of a detergent composition according to example 1 showed the following remission values:
C=63.8/63.4
RPC=84.5/85.8
RC=56.5/57.8

We claim:

1. A low-water content surfactant mixture which is pourable and pumpable at ambient conditions having high wetting power and detergency when used in a fabric detergent composition, said surfactant mixture having a water content of less than about 20% by weight, and consisting of:

1. from about 50 to about 65% by weight of a $C_{12}$–$C_{18}$ fatty alcohol ethoxylate containing an average of about 10 moles of ethylene oxide which is a solid at room temperature and has a melting point of about 30° C.;
2. from about 5 to about 15% by weight of an alkali metal salt of a $C_{16}$–$C_{18}$ tallow alcohol sulfate which is a solid at room temperature and has a melting point of from about 55° to about 60° C.;
3. from about 4 to about 15% by weight of a $C_{12}$–$C_{16}$ alkane sulfonate alkali metal salt or the disodium salt of n-octyl sulfosuccinate which is a solid at room temperature; and
4. from about 5 to about 13% by weight of a free $C_{16}$–$C_{18}$ fatty acid having a melting point of about 55° C., all weights being based on the total weight of said surfactant mixture.

2. A surfactant mixture as in claim 1 wherein said water content is less than about 15% by weight.

3. A surfactant mixture as in claim 1 consisting of:

1. from 57 to about 62% by weight of said $C_{12}$–$C_{18}$ fatty alcohol ethoxylate containing an average of about 10 moles of ethylene oxide;
2. from about 7 to about 10% by weight of said alkali metal salt of a $C_{16}$–$C_{18}$ tallow alcohol sulfate;
3. from about 8 to about 12% by weight of said $C_{12}$–$C_{16}$ alkane sulfonate alkali metal salt and/or said disodium salt of n-octyl sulfosuccinate; and
4. from about 6 to about 10% by weight of said free $C_{16}$–$C_{18}$ fatty acid.

4. A surfactant mixture as in claim 3 wherein said water content is less than about 15% by weight.

5. A surfactant mixture as in claim 1 consisting of:

1. about 60% by weight of said $C_{12}$–$C_{18}$ fatty alcohol ethoxylate containing an average of about 10 moles of ethylene oxide;
2. from about 8.5 to about 9% by weight of said alkali metal salt of a $C_{16}$–$C_{18}$ tallow alcohol sulfate;
3. from about 9 to about 10% by weight of said $C_{12}$–$C_{16}$ alkane sulfonate alkali metal salt and/or said disodium salt of n-octyl sulfosuccinate; and
4. about 8% by weight of said free $C_{16}$–$C_{18}$ fatty acid.

6. The process of preparing a powder detergent composition consisting of spray-mixing preformed free-flowing detergent components with up to about 20% by weight, based on the weight of said detergent composition, of a low-water content surfactant mixture which is pourable and pumpable at ambient conditions, said surfactant mixture having a water content of less than about 20% by weight and consisting of:

1. from about 50 to about 65% by weight of a $C_{12}$–$C_{18}$ fatty alcohol ethoxylate containing an average of about 10 moles of ethylene oxide which is a solid at room temperature and has a melting point of about 30° C.;
2. from about 5 to about 15% by weight of an alkali metal salt of a $C_{16}$–$C_{18}$ tallow alcohol sulfate which is a solid room at temperature and has a melting point of from about 55° to about 60° C.;
3. from about 4 to about 15% by weight of a $C_{12}$–$C_{16}$ alkane sulfonate alkali metal salt or the disodium salt of n-octyl sulfosuccinate which is a solid at room temperature; and
4. from about 5 to about 13% by weight of a free $C_{16}$–$C_{18}$ fatty acid having a melting point of about 55° C., based on the weight of said surfactant mixture.

7. A process in accordance with claim 6 wherein said water content in said surfactant mixture is less than about 15% by weight.

8. A process in accordance with claim 6 wherein said surfactant mixture consists of:

1. from about 57 to about 62% by weight of said $C_{12}$–$C_{18}$ fatty alcohol ethoxylate containing an average of about 10 moles of ethylene oxide;
2. from about 7 to about 10% by weight of said alkali metal salt of a $C_{16}$–$C_{18}$ tallow alcohol sulfate;
3. from about 8 to about 12% by weight of said $C_{12}$–$C_{16}$ alkane sulfonate alkali metal salt and/or said disodium salt of n-octyl sulfosuccinate; and
4. from about 6 to about 10% by weight of said free $C_{16}$–$C_{18}$ fatty acid.

9. A process in accordance with claim 8 wherein said water content in said surfactant mixture is less than about 15% by weight.

10. A process in accordance with claim 6 wherein said surfactant mixture consists of:

1. about 60% by weight of said $C_{12}$–$C_{18}$ fatty alcohol ethoxylate containing an average o fabout 10 moles of ethylene oxide;
2. from about 8.5 to about 9% by weight of said alkali metal salt of a $C_{16}$–$C_{18}$ tallow alcohol sulfate;
3. from about 9 to about 10% by weight of said $C_{12}$–$C_{16}$ alkane sulfonate alkali metal salt and/or said disodium salt of n-octyl sulfosuccinate; and
4. about 8% by weight of said free $C_{16}$–$C_{18}$ fatty acid.

11. A free-flowing, powder detergent composition prepared by spray-mixing preformed powder detergent components with up to about 20% by weight, based on the weight of said detergent composition, of a low-water content surfactant mixture which is pourable and pumpable at ambient conditions, said surfactant mixture having a water content of less than about 20% by weight and consisting of:

1. from about 50 to about 65% by weight of a $C_{12}$–$C_{18}$ fatty alcohol ethoxylate containing an average of about 10 moles of ethylene oxide which is a solid at room temperature and has a melting point of about 30° C.;
2. from about 5 to about 15% by weight of an alkali metal salt of a $C_{16}$–$C_{18}$ tallow alcohol sulfate which is a solid at room temperature and has a melting point of from about 55° to about 60° C.;

3. from about 4 to about 15% by weight of a $C_{12}$–$C_{16}$ alkane sulfonate alkali metal salt or the disodium salt of n-octyl sulfosuccinate which is a solid at room temperature; and
4. from about 5 to about 13% by weight of a free $C_{16}$–$C_{18}$ fatty acid having a melting point of about 55° C., based on the weight of said surfactant mixture.

12. A detergent composition in accordance with claim 11 wherein said water content in said surfactant mixture is less than about 15% by weight.

13. A detergent composition in accordance with claim 11 wherein said surfactant mixture consists of:

1. from about 57 to about 62% by weight of said $C_{12}$–$C_{18}$ fatty alcohol ethoxylate containing an average of about 10 moles of ethylene oxide;
2. from about 7 to about 10% by weight of said alkali metal salt of a $C_{16}$–$C_{18}$ tallow alcohol sulfate;
3. from about 8 to about 12% by weight of said $C_{12}$–$C_{16}$ alkane sulfonate alkali metal salt and/or said disodium salt of n-octyl sulfosuccinate; and
4. from about 6 to about 10% by weight of said free $C_{16}$–$C_{18}$ fatty acid.

14. A detergent composition in accordance with claim 13 wherein said water content in said surfactant mixture is less than about 15% by weight.

15. A detergent composition in accordance with claim 11 wherein said surfactant mixture consists of:

1. about 60% by weight of said $C_{12}$–$C_{18}$ fatty alcohol ethoxylate containing an average of about 10 moles of ethylene oxide;
2. from about 8.5 to about 9% by weight of said alkali metal salt of a $C_{16}$–$C_{18}$ tallow alcohol sulfate;
3. from about 9 to about 10% by weight of said $C_{12}$–$C_{16}$ alkane sulfonate alkali metal salt and/or said disodium salt of n-octyl sulfosuccinate; and
4. about 8% by weight of said free $C_{16}$–$C_{18}$ fatty acid.

16. A detergent composition in accordance with claim 11 wherein said preformed powder detergent components comprise a conventional builder selected from the group consisting of sodium tripolyphosphate and zeolite NaA.

* * * * *